US009102440B2

(12) United States Patent
Cook et al.

(10) Patent No.: US 9,102,440 B2
(45) **Date of Patent: *Aug. 11, 2015**

(54) CARRIER CAPABLE OF HANGING FROM A BACK OF A CONTAINER

(75) Inventors: Matthew R. Cook, Hinsdale, IL (US); Barry L. Silverstein, Northbrook, IL (US); Kurt M. Wolf, Evanston, IL (US); James A. Hubbard, Jr., Oak Lawn, IL (US)

(73) Assignee: LBP MANUFACTURING, INC., Cicero, IL (US)

( * ) Notice: Subject to any disclaimer, the term of this patent is extended or adjusted under 35 U.S.C. 154(b) by 40 days.

This patent is subject to a terminal disclaimer.

(21) Appl. No.: 12/819,628

(22) Filed: Jun. 21, 2010

(65) Prior Publication Data

US 2010/0252456 A1 Oct. 7, 2010

Related U.S. Application Data

(63) Continuation of application No. 11/362,482, filed on Feb. 24, 2006, now Pat. No. 7,740,139.

(51) Int. Cl.
*B65D 85/62* (2006.01)
*B65D 21/02* (2006.01)

(52) U.S. Cl.
CPC ..... *B65D 21/0238* (2013.01)

(58) Field of Classification Search
USPC ..... 206/141, 549, 144, 162, 217, 180, 190, 206/170, 176, 156, 158, 151, 175, 194, 216, 206/427, 174, 193, 541
See application file for complete search history.

(56) References Cited

U.S. PATENT DOCUMENTS

| | | | |
|---|---|---|---|
| 2,175,600 | A | 10/1939 | Greco |
| 2,281,592 | A | 5/1942 | O'Brien |
| 2,704,625 | A | 3/1955 | Huse |
| 2,748,978 | A | 6/1956 | Hennessey et al. |

(Continued)

FOREIGN PATENT DOCUMENTS

GB 2 035 961 6/1980

OTHER PUBLICATIONS

Canadian Examiner's Report from Canadian patent application No. CA 2,572,721, 3pp., Aug. 14, 2008.

(Continued)

*Primary Examiner* — Andrew Perreault
(74) *Attorney, Agent, or Firm* — Hasse & Nesbitt LLC; Daniel F. Nesbitt

(57) ABSTRACT

A carrier has a bottom, a plurality of side panels connected to the bottom, and a handle panel. The handle panel is connected to one of the side panels or the bottom. The handle panel includes a fold line, a first aperture, a second aperture, a first perforated line in continuation of the first aperture and the second aperture, and a second perforated line defining a finger opening in the handle panel. Pressure applied on the first perforated line tears apart material to produce a third aperture in continuation of the first aperture and the second aperture. Pressure applied inside the second perforated line dislocates material to produce the finger opening. When the third aperture is open in continuation of the first aperture and the second aperture, the handle panel folds along the fold line over a container to facilitate penetration of a handle of the container through the first aperture, the second aperture, and the third aperture.

20 Claims, 14 Drawing Sheets

(56) References Cited

U.S. PATENT DOCUMENTS

| | | | |
|---|---|---|---|
| 2,911,126 | A | 11/1959 | Hotton |
| 3,018,919 | A | 1/1962 | Pelt |
| 3,640,380 | A | 2/1972 | Huffman |
| 3,912,157 | A | 10/1975 | Graser |
| D242,685 | S | 12/1976 | Skidell |
| 4,286,709 | A | 9/1981 | Manizza |
| 4,453,664 | A | 6/1984 | Oliff |
| 4,548,352 | A | 10/1985 | Capo et al. |
| 4,601,390 | A | 7/1986 | Rosenthal et al. |
| 4,610,349 | A | 9/1986 | Schwartz et al. |
| 4,805,864 | A | 2/1989 | Votta |
| 4,930,629 | A | 6/1990 | Petty |
| 4,936,470 | A | 6/1990 | Prindle |
| 4,979,657 | A | 12/1990 | Espiritu |
| 5,031,760 | A | 7/1991 | Stout |
| 5,052,552 | A | 10/1991 | Maroszek |
| 5,069,335 | A | 12/1991 | Beales |
| 5,118,034 | A | 6/1992 | Tsao |
| 5,221,001 | A | 6/1993 | Eisman |
| 5,267,644 | A | 12/1993 | Tsao |
| 5,358,175 | A | 10/1994 | Cai |
| 5,423,478 | A | 6/1995 | Roosa |
| 5,427,308 | A | 6/1995 | Swift et al. |
| 5,524,814 | A | 6/1996 | Davis |
| 5,682,985 | A | 11/1997 | Plaxico et al. |
| 5,695,051 | A | 12/1997 | Hart |
| 5,738,217 | A | 4/1998 | Hunter |
| 5,765,684 | A | 6/1998 | Van Dore et al. |
| 5,775,574 | A | 7/1998 | Whitnell |
| 5,803,264 | A | 9/1998 | Gersten et al. |
| 5,850,911 | A | 12/1998 | Pakzad |
| 5,909,841 | A | 6/1999 | Andrews, Sr. et al. |
| 5,927,502 | A | 7/1999 | Hunter |
| 6,045,038 | A | 4/2000 | Smith et al. |
| 6,068,127 | A | 5/2000 | Hunter |
| 6,183,027 | B1 | 2/2001 | Tsao |
| 6,189,687 | B1 | 2/2001 | Bakx |
| 6,196,452 | B1 | 3/2001 | Andrews, Sr. et al. |
| D442,483 | S | 5/2001 | Holden |
| 6,290,124 | B2 | 9/2001 | Andrews, Sr. et al. |
| 6,394,265 | B1 | 5/2002 | Tsao |
| 6,398,078 | B1 | 6/2002 | Moran et al. |
| D461,712 | S | 8/2002 | Davis |
| 6,439,452 | B1 | 8/2002 | Tsao |
| 6,443,308 | B1 | 9/2002 | Davis |
| 6,460,697 | B1 | 10/2002 | Stevens |
| 6,732,857 | B2 | 5/2004 | Bakx |
| 6,802,208 | B2 | 10/2004 | Chinitz et al. |
| 6,832,687 | B2 | 12/2004 | Davis |
| 6,834,762 | B2 | 12/2004 | Krisko et al. |
| 7,077,309 | B2 * | 7/2006 | Andrews, Sr. ..... 229/117.15 |
| 7,383,949 | B2 | 6/2008 | Coumo |
| 7,735,640 | B2 | 6/2010 | Cook et al. |
| 7,740,139 | B2 | 6/2010 | Cook et al. |
| 2002/0047040 | A1 | 4/2002 | Andrews, Sr. et al. |
| 2002/0179459 | A1 | 12/2002 | Bakx |
| 2003/0106828 | A1 | 6/2003 | Hunter |
| 2003/0111363 | A1 | 6/2003 | Theelen |
| 2003/0134059 | A1 | 7/2003 | Andrews, Sr. et al. |
| 2003/0209454 | A1 | 11/2003 | Hunter |
| 2003/0213263 | A1 | 11/2003 | Woog |
| 2004/0055908 | A1 | 3/2004 | Cuomo |
| 2004/0124107 | A1 | 7/2004 | Cuomo |
| 2004/0159577 | A1 | 8/2004 | Hunter |
| 2004/0226989 | A1 | 11/2004 | Cook et al. |
| 2005/0035009 | A1 | 2/2005 | Cuomo |

OTHER PUBLICATIONS

European Search Report from European patent application No. 07 25 0566.2, 9pp., Feb. 4, 2008.

Partial European Search Report from European patent application No. EP 07 25 0566, 1p., Jun. 5, 2007.

* cited by examiner

CARRIER CAPABLE OF HANGING FROM A BACK OF A CONTAINER

PRIORITY CLAIM

This application is a continuation application of U.S. patent application Ser. No. 11/362,482 filed Feb. 24, 2006, now U.S. Pat. No. 7,740,139 which is hereby incorporated by reference in its entirety.

BACKGROUND

Consumers frequently purchase ready-made coffee, and other beverages, in bulk beverage containers, such as for the office and catering. Beverages are often purchased with other food items, such as pastries, sandwiches, and condiments. Many coffee-shops and fast food establishments also carry items such as compact discs, reading material, and coffee brewing equipment.

Although the bulk beverage containers are often more convenient than carrying several cups of, often hot, beverages, the consumer may still need carry serving supplies, food items and/or other items in their other hand. This may make it difficult to carry a purse, professional case, and other items that the consumer may have.

BRIEF SUMMARY OF THE INVENTION

A carrier has a bottom, a plurality of side panels connected to the bottom, and a handle panel. The handle panel is connected to one of the side panels or the bottom. The handle panel includes a fold line, a first aperture, a second aperture, a first perforated line in continuation of the first aperture and the second aperture, and a second perforated line defining a finger opening in the handle panel. Pressure applied on the first perforated line tears apart material to produce a third aperture in continuation of the first aperture and the second aperture. Pressure applied inside the second perforated line dislocates material to produce the finger opening. When the third aperture is open in continuation of the first aperture and the second aperture, the handle panel folds along the fold line over a container to facilitate penetration of a handle of the container through the first aperture, the second aperture, and the third aperture.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

A carrier may be used alone or in combination with a container, such as a bulk beverage container, or other similar containers such as food containers and pet containers. The carrier may be used to carry beverages, condiments and/or other items such as food items. The carrier may fit over a handle of the container and hang on a side and/or back of the container. The carrier may also be used in combination with other carriers to form other configurations of carriers. The carrier may permit an establishment to purchase one carrier-type for multiple uses.

Figure 1:
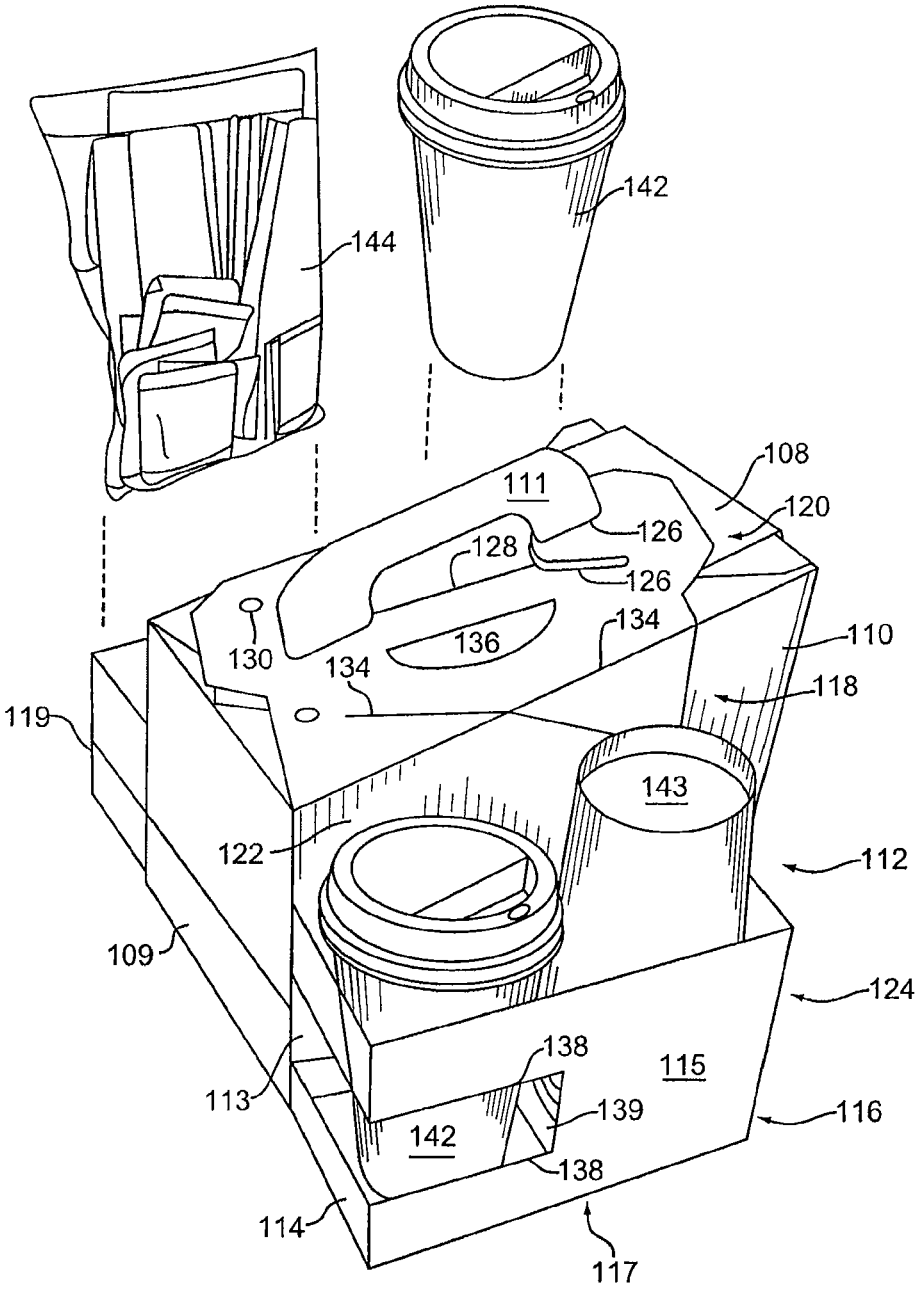
FIG. 1 is a perspective view of a container with two assembled carriers.
Figure 3:
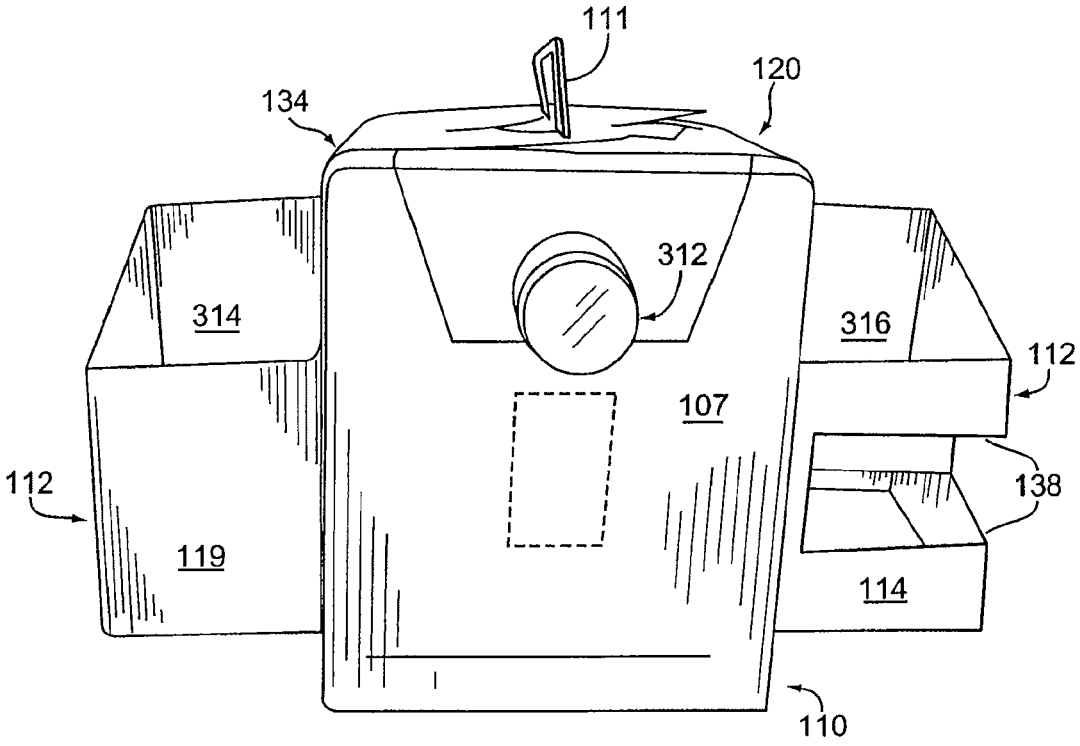
FIG. 3 is a front view of a container with two assembled carriers.
Figure 4:
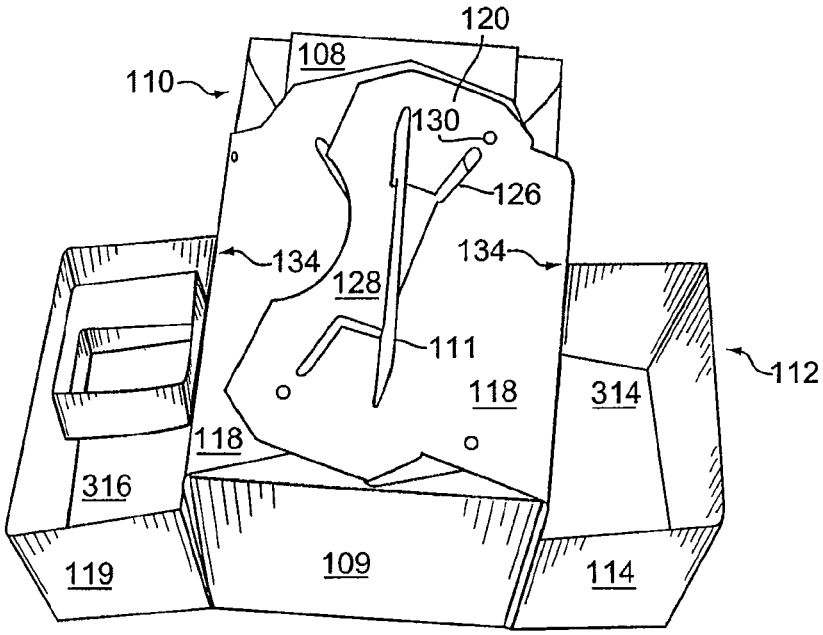
FIG. 4 is a top view of a container with two assembled carriers.

FIGS. 1, 3 and 4 illustrate a container 110 and a carrier 112 in their assembled forms. The carrier includes a storage container which may convert to a one, two or more-cell container. The carrier 112 may hang from the handle 111 on the top 108 of the container 110 to a side 109 of a container 110. The top 108 of the container 110 may be angled, and therefore not parallel with the bottom side, so a portion of the carrier 112 may also be angled.

The carrier 112 includes an upwardly open compartment 124 and a handle panel 118 that may be integral therewith. The compartment 124 may be of an elongate rectangular configuration, and other shapes may be used. The compartment has a first end panel 114, a second end panel 119, a first side panel 115 and a second side panel 113 extended between the end panels and joined thereto at the corners 116, such as by appropriate fold lines. The bottom of the compartment 117 may support items that are placed inside the carrier 112.

The compartment may include one or more separate compartments. A single compartment may be transformed to a double-space compartment with the use of a corner area 116 of the compartment that contains cutting lines 138 that form a horizontal band 139. A compartment divider may be formed by pressing the corner area 116 of the compartment inward. The corner area 116 can be replaced in its original position 138 to regain the full space of the compartment.

The first side panel 113 may be extended and form a handle panel 118 that that fits over the handle 111 of a container 110. The handle panel 118 may include two distinct regions: an elongated head region 120; and a neck region 122 that may be narrower than the head region 120 and may join the head region 120 to the compartment 124 at the first side panel 113.

The head region 120 may contain four separate apertures 126. These apertures 126 may afford the carrier handle panel 118 a snug, secure fitting. The apertures 126 may be arranged to permit the compartment to be placed on either side of the container 110. The apertures 126 may be angled to accommodate an angled container 110 such that when positioned in a resting position on the container 110, the carrier 112 may be positioned generally parallel to the ground.

Two folds 134 in the handle panel 118 align the compartment on either side of the container 110. Holes 130 in the handle panel 118 assist in aligning the carrier 112 on the handle 111 of the container. A central flap region 128 may lie between the apertures 126 to further secure the carrier's handle panel 118 to the handle 111 of the container 110.

The handle panel 118 may also contain cutting lines to define an alternative handle flap 136. The flap 136 is convex only for illustrative purposes. The flap 136 may have other shapes, such as rectangular or triangular. Alternatively, the flap 136 may be replaced with one or more finger holes. Pushing inward on the flap 136 may reveal a transversely elongated finger opening. The consumer may have the option of using one or two carriers 112 on each container 110, depending on the amount to be carried.

FIGS. 1, 3, and 4 illustrate the use of the container 110 with two carriers 112. When used together, one handle flap 118 may lie on top of the other. One compartment 124 may hang on each side of the container 110. Each compartment can hold pastries, bagels, cookies, drinks 142, extra cups 143, napkins, condiments 144, and other store items, such as compact disks, reading material, and cooking utensils. These items may also be carried in the compartment 124.

Figure 2:
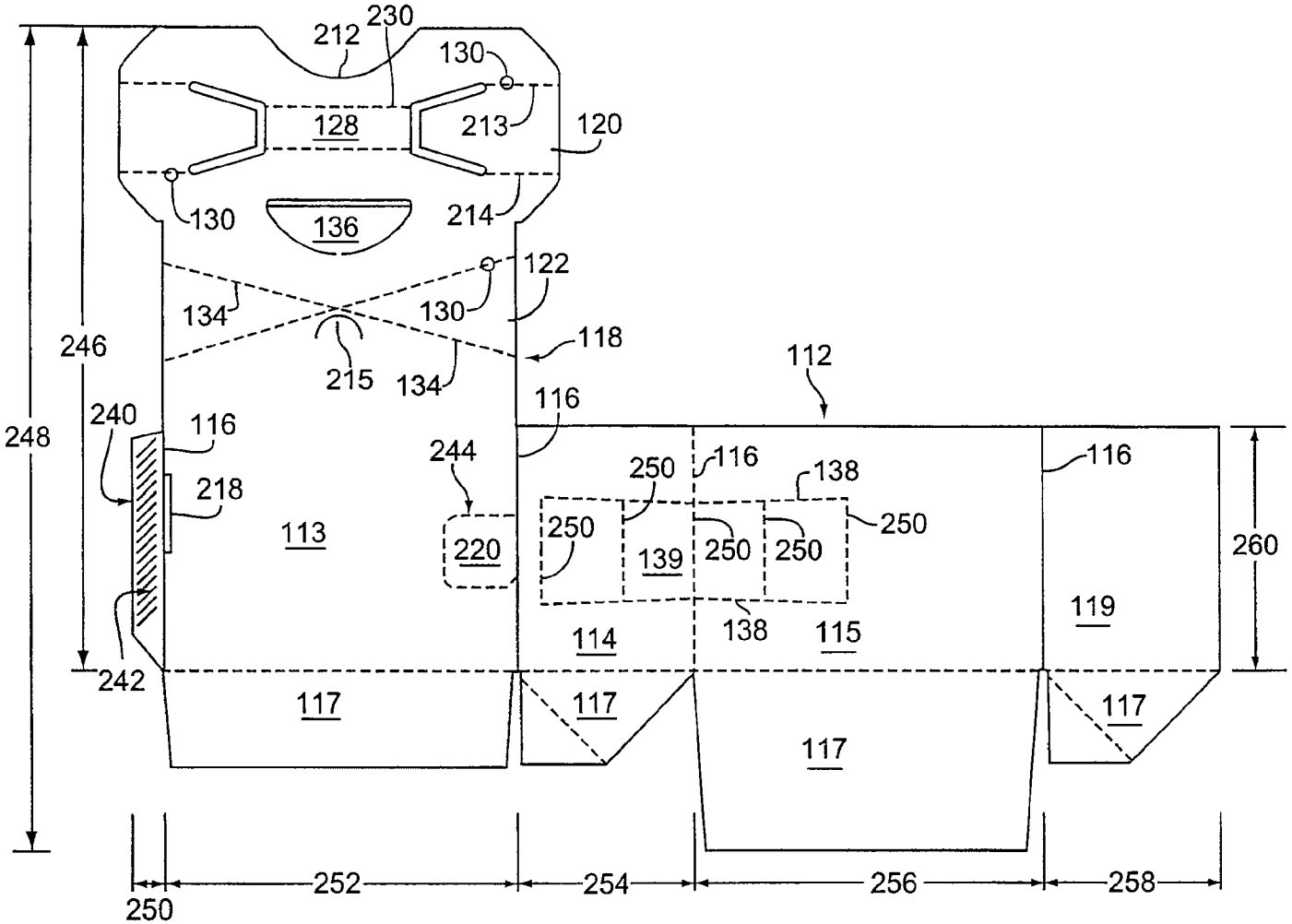
FIG. 2 is a top plan view of the interior surface of a blank from which the carrier of FIG. 1 can be assembled.

FIG. 2 shows an exemplary blank of the carrier 112. The carrier may be composed of a generally flat material having some rigidity and being capable of being bent or scored to facilitate bending along determined lines. An exemplary material is paperboard. The material may be coated, such as to provide increased water or fluid resistance and may have printing on selected portions of the material.

Alternatively or additionally, the carrier 112 may be composed of corrugated cardboard, chipboard, plywood, SBS, metal, plastic, fabric, ceramic, polymer, fibers, mesh, screen, wood, composite, mixtures or combinations of the foregoing, or the like. The carrier 112 may be made of one or more layers of one or more of the aforementioned materials. Where multiple layers of material are used they may be joined, such as, but not limited to, being laminated, glued, or otherwise fastened together for increased strength.

The carrier 112 may be a die cut from a single sheet of material. Alternatively, two or more segments of material may be used and joined together. While the carrier 112 material is preferably scored, where a plurality of panels or segments are used they can be joined using hinge or joint mechanisms. By score, it is meant to include a cut through a portion of the carrier sheet (either a continuous cut or a line of slits, holes, or perforations), or a weakened area, or a compressed area on at least one face of the sheet or other technique to permit bending of the material along a preferred line. The carrier may be constructed of a series of generally rectangular panels denoted by numerals 113, 114, 115, and 119 joined by fold or score lines 116. Flap 240 may include an adhesive 242, such as glue. Bottom forming panels denoted as 117 may form a pressure lock configuration, which may close to form a sturdy bottom when items are placed inside. Scored lines 250 may be used to create flexibility in the horizontal band 139 defined by cut lines 138.

The first side panel 113 may extend to form a handle panel 118 that fits over the handle of a container such as container 110. First 213 and second 214 scored fold lines permit the head region 120 to fold. Folding the head region brings a cut out portion 212 into alignment with the alternative handle flap 136. The cut out 212 portion is convex only for illustrative purposes. The cut out 212 may have other shapes, such as rectangular or triangular. The cut out portion 212 provides clearance for the handle flap 136 when it is punched through to reveal the transversely elongated finger opening. A latch lug 220 may be defined on three sides by cutting lines 244 which allow the latch lug 220 to flex resiliently outward from the corresponding first side panel 113.

Numerals 246, 248, 250, 252, 254, 256, 258, and 260 provide an illustrative example of possible dimensions of the blank. The detailed description of possible dimensions that follows is merely illustrative and not limiting.

Dimension 246 of the carrier 112 may be 12.221 inches. Dimension 248 of the carrier 112 may be 15.596 inches. Dimension 250 of the carrier 112 may be ⅝ inches. Dimension 252 of the carrier 112 may be 6¾ inches. Dimension 254 of the carrier 112 may be 3 7/16 inches. Dimension 256 of the carrier 112 may be 6¾ inches. Dimension 258 of the carrier 112 may be 3 13/32 inches. Dimension 260 of the carrier 112 may be 4⅝ inches. These dimensions are illustrative only and may be varied to tailor the carrier to the dimensions of the container.

Referring to FIG. 3, the container 110 may be fitted with a mouth 312 for passage of contents from an inside of the container 110 to an outside of the container 110, and vice versa, such as for loading and/or emptying contents. The carriers 112 may be duplicates arranged in opposite orientations. Numeral 314 illustrates a carrier in an open state where the divider band 139 is not punched in. Numeral 316 illustrates a carrier in a multi-compartment state where the divider band 139 is punched in. Either one or both of the corner areas 116 of the carriers 112 may contain divider bands 139 which may turn a single compartment into a multiple compartment. Both carriers 112 may lie flat against the sides of the container 110 due to folding along the scored lines 134. The head portion 120 of the handle panel 118 may lie flat against the top of the container 110. The head portion of the first carrier may lie flat on top of the head portion of the second carrier.

FIG. 4 shows a top view of the container 110 fitted with the two carriers 112. The carriers 112 may be suspended from the handle 111 of the container 110 by the handle panel 118. The head region 120 may have angled apertures 126 which fit over the container's handle 111. The central flap region 128 between the sets of angled apertures 126 may provide a snug, secure fit. The first carrier 112 may lie layered on top of the second carrier 112. Scored bending lines 134 may allow the carriers 112 to lie against the side of the container 110.

Figure 5:
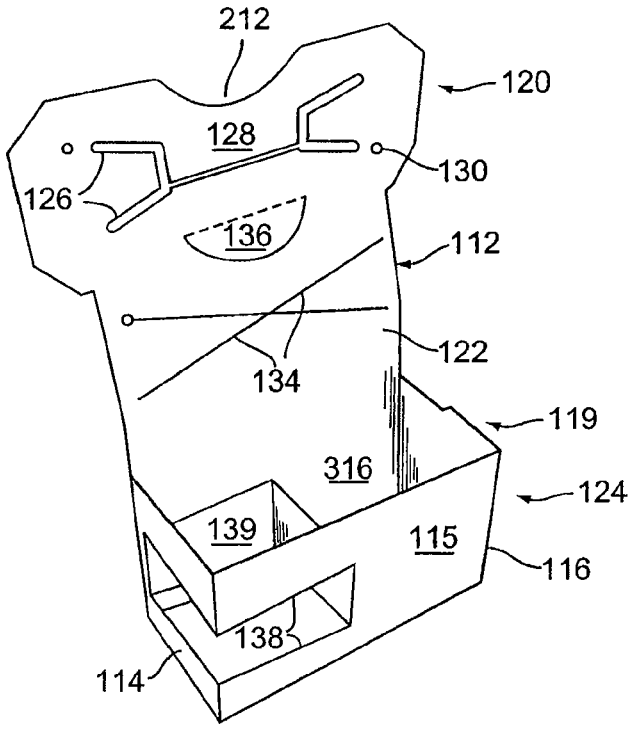
FIG. 5 is a perspective view illustrating a carrier separate from a container.

FIG. 5 is a perspective view of the carrier 112 independent of the container 110. The carrier 112 is in a partially unfolded state. By folding the head region 120, or handle flap 118, the carrier 112 may be used as a carrier independent of the container 110.

Figure 6:
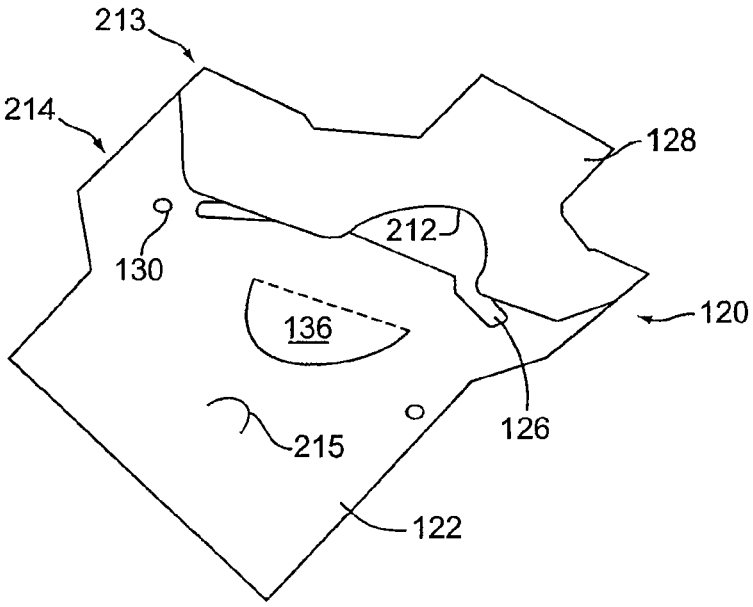
FIG. 6 is an exploded detail of the head and neck portion of the carrier of FIG. 1 illustrating a first step of an exemplary folding option.
Figure 7:
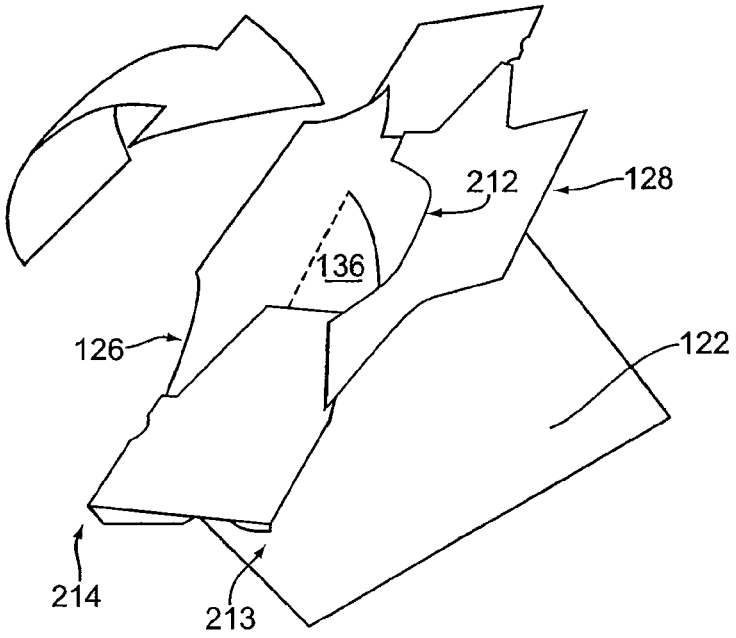
FIG. 7 is an exploded detail of the head and neck portion of the carrier of FIG. 1 illustrating a second step of an exemplary folding option.
Figure 8:
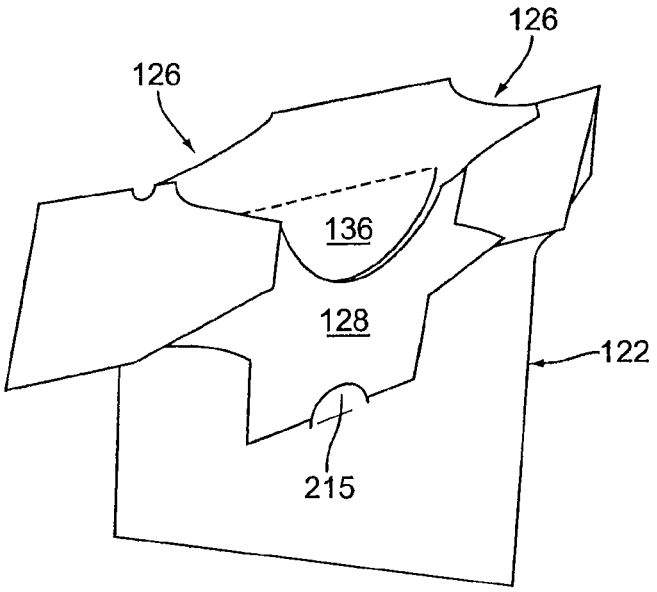
FIG. 8 is an exploded detail view of the head and neck portion of the carrier of FIG. 1 illustrating an exemplary folding option.

FIGS. 6-8 illustrate an exemplary way to fold the head portion 120 for use of the carrier 112 without a container 110. FIG. 6 illustrates the first exemplary fold. Folding the head region 120 along the first fold line 213 brings the flap section 128 into outward orientation and the cut out region 212 into inward orientation. FIG. 7 illustrates the second exemplary fold for separate carrier set-up. Folding the head region 120 at the second head region fold line 214 aligns the cut out region 212 with the cutting lines of the alternative handle flap 136. FIG. 8 illustrates the final exemplary orientation of the head region in the separate carrier set-up. The flap section 128 is downwardly oriented and secured by a flange 215. The cut out region 212 is aligned with the cutting lines of the alternative handle flap 136. Pushing in on the alternative handle flap 136 creates the transversely elongated finger opening. The carrier as described, may be used either as a companion to a container, as a single unit, or in interlocked tandem with a duplicate carrier.

Figure 9:
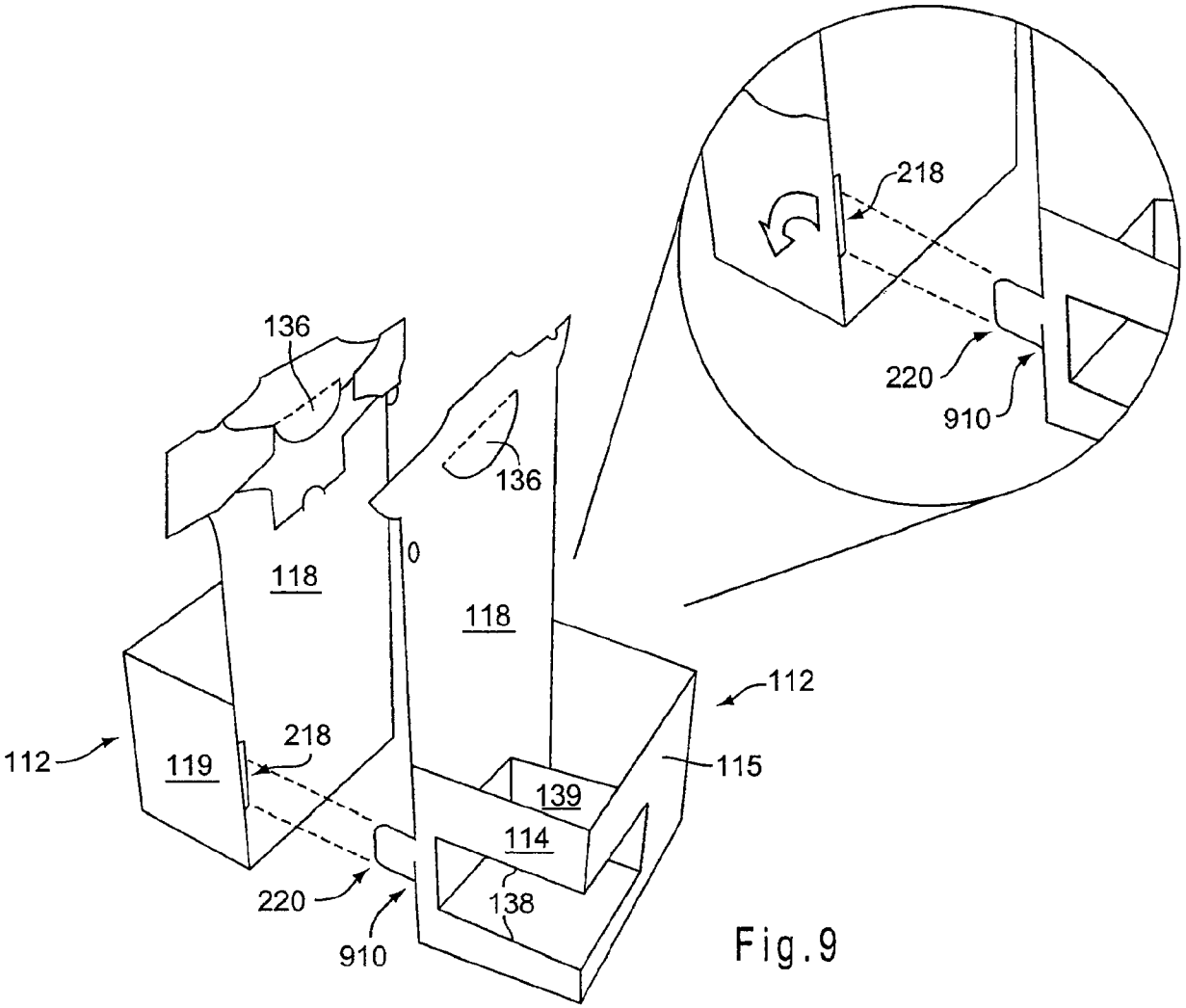
FIG. 9 is a perspective view of a partially assembled double carrier with an exploded detail illustration of latching components.

FIG. 9 illustrates two carriers 112 being joined together to form another carrier larger than the carrier 112. The joining of carriers 112 may form a tandem carrier simply and rapidly, such as by utilizing the single latch assembly 218 and 220. The two carriers may be positioned slightly longitudinally offset from each other with the latch lugs 220 aligned with the latch apertures 218 of the opposed carrier. The carriers are then longitudinally slid toward each other to engage each latch lug 220 into the latch aperture 218 of the opposed carrier. Latching the carriers together may restrict lateral separation of the carriers. An example of the possible latching mechanism follows. The example is merely illustrative as other latching mechanisms may be used.

The latch lug 220 may be arranged continuous with the first end panel 114. The latch lug 220 may be generally rectangular with rounded corners, but other shapes may be used. To further stabilize and insure the integrity of latching, each latch lug 220 may be retained in its final latching position by a locking notch 910 in the lower corner and flush with the first end panel 114. Once the latch lug 220 has been projected completely through the latch aperture 218, it may lie against the respective inner faces of the end panels 114 and 119. By pushing down on the containers, the locking notch 910 may engage a portion of the corner panel 116 to secure the latch. When so engaged, possible accidental or unintentional disengagement of the two carriers is reduced, particularly when the compartments are occupied with store items. Any load within the compartment will, by the natural direction of the load force, retain the compartments in lateral engagement with each other. If the carriers are to be disengaged, a positive manual manipulation, involving an upward pivoting and release of the locking notch and subsequent manipulation of the lug 220 may be required.

Figure 10:
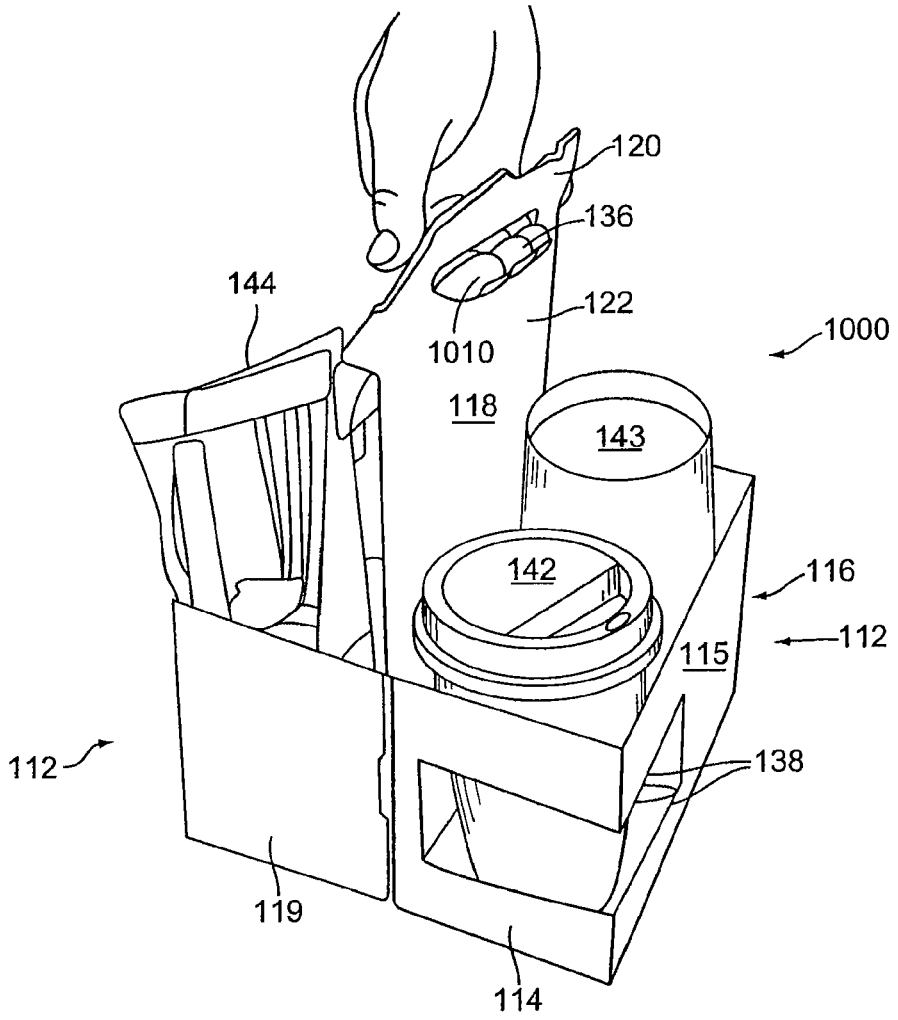
FIG. 10 is a perspective view of two carriers assembled together to form an alternate variation of the carrier.

FIG. 10 is a perspective view of two carriers 112 assembled together in tandem to form a carrier 1000. Folding of the head region 120 and pushing inward on the alternative handle flap 136 may reveal transversely elongated finger opening 1010. The flap 136 of the first carrier, when inserted through the finger opening 1010 of the second carrier may secure the head panels and may provide protection and cushioning for the fingers. This arrangement may allow for the transport of multiple beverages 142 and condiments 144, or other items. With the two carriers interlocked, the first and second alternative handle flaps 136 may align transversely across the assembly and the two elongate finger openings 1010 may be positioned for easy grasping by one hand. The positive interlock between the carriers within the handles themselves, created by insertion of the alternative handle flap 136 of the first carrier through the elongate finger opening 1010 of the second carrier, provides for a positive retention of the handles against each other in a manner which substantially defines a single handle for ready access thereto.

Figure 11:
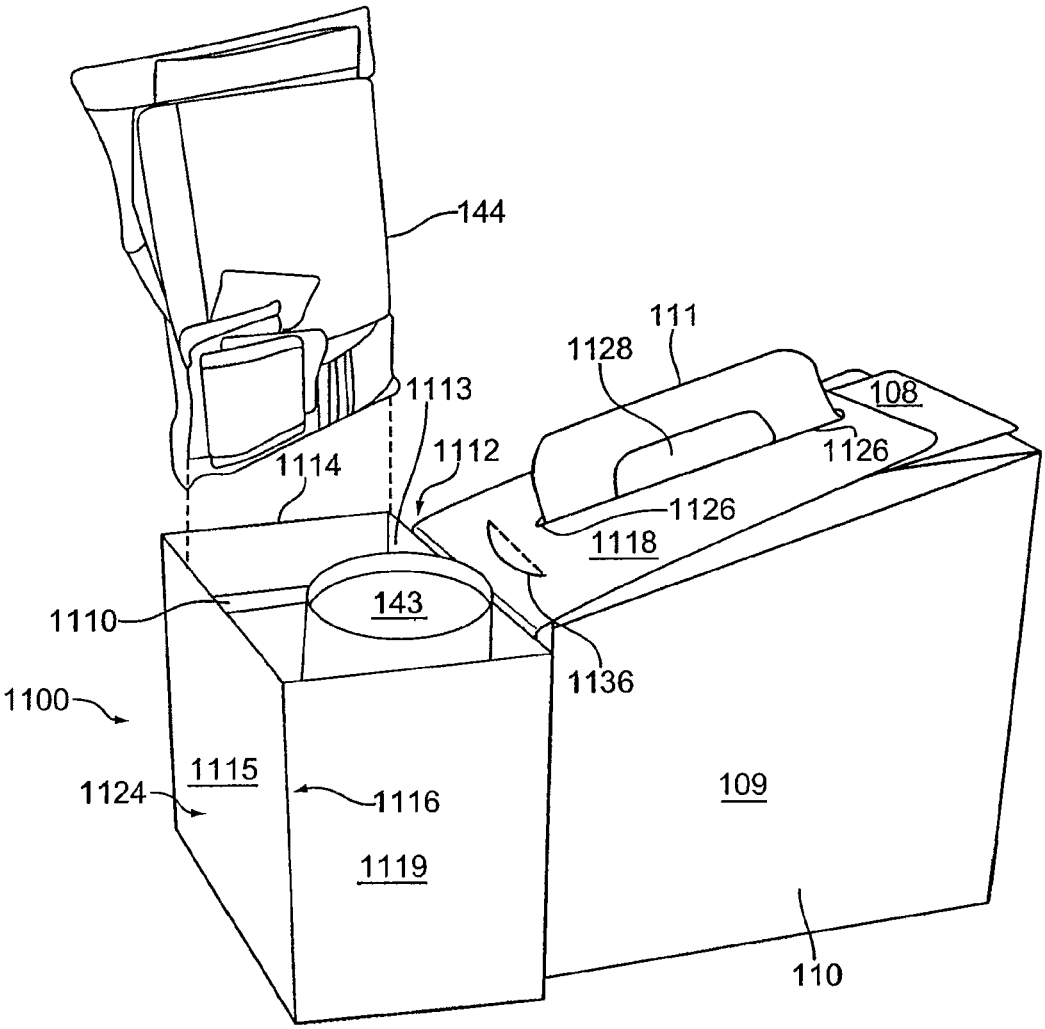
FIG. 11 is a perspective view of another carrier used with the container of FIG. 1.

FIG. 11 illustrates a perspective view of another carrier 1100 in its assembled form. The carrier 1100 may be made of paperboard or other materials, such as those described above. The carrier 1100 may hang on the back side of a container, such as the container 110 described above. The carrier 1100 may include one or more compartments 1124. A handle panel 1118 may be integral with the first side panel 1113 of the compartment 1124. The handle panel 1118 may include two apertures 1126 dimensioned to fit over the handle 111 of the container 110, permitting a snug fit.

The compartment may be divided by two foldable handle panels 1110, which are folded into the compartment 1124 in this configuration. A plane of the foldable handle panels may be transverse to the carrier side panels and parallel to the carrier end panels. The compartment 1124 can contain drinks 142, extra cups 143, napkins, condiments 144, pastries, bagels, and other store items. The fold line 1112 may allow the carrier to lie flat against the back side of the container 110. This carrier may make transporting numerous items more convenient.

Figure 12:
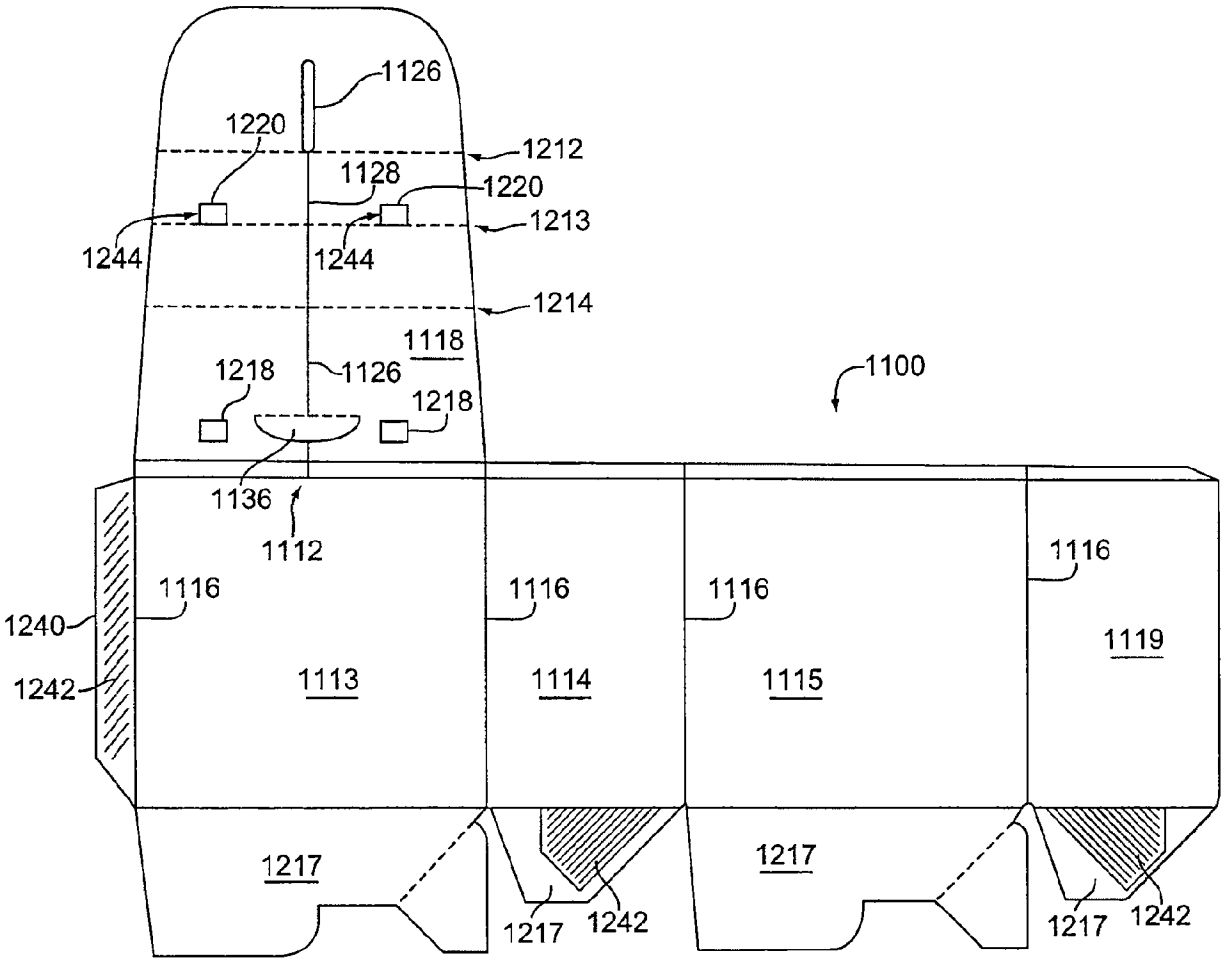
FIG. 12 is a top plan view of the interior surface of a blank from which the carrier of FIG. 11 can be assembled.

FIG. 12 illustrates an exemplary blank of the carrier 1100. The carrier 1100 may be advantageously configured to be constructed from a single one piece paper board plank. The carrier may be constructed of a series of generally rectangular panels denoted by numerals 1113, 1114, 1115, and 1119 joined by fold lines or score lines 1116. The flap 1240 may be secured using glue 1242 or another adhesive, from top to bottom. Bottom forming panels denoted as 1217 may be glued 1242.

A perforated central region 1128 may extend between the two apertures 1126 in the handle panel 1118. The handle panel 1118 may further include several scored folding lines 1212, 1213, and 1214. The handle panel 1118 may also include two horizontal latching lugs 1220 which may be defined by cutting lines on three sides 1244. The base of the latching lugs 1220 may be aligned with the second folding line 1213 such that when the handle panel 1118 is folded at the second fold line 1213 and the latching lugs 1220 are punched out, they flex resiliently outward from the second fold line 1213. The latching lugs 1220 may be aligned with horizontal latching apertures 1218 at near the intersection of the handle panel 1118 with the first side panel 1113. The latching lugs 1220 are shown associated with the second fold line 1213 only for illustration. The latching lugs 1220 may be multiple or singular, may be of any shape, and may be located anywhere along the handle panel 1118. The latching apertures 1218 may be altered accordingly. Alternatively, the latching apertures may be omitted from the handle panel 1118.

Figure 13:
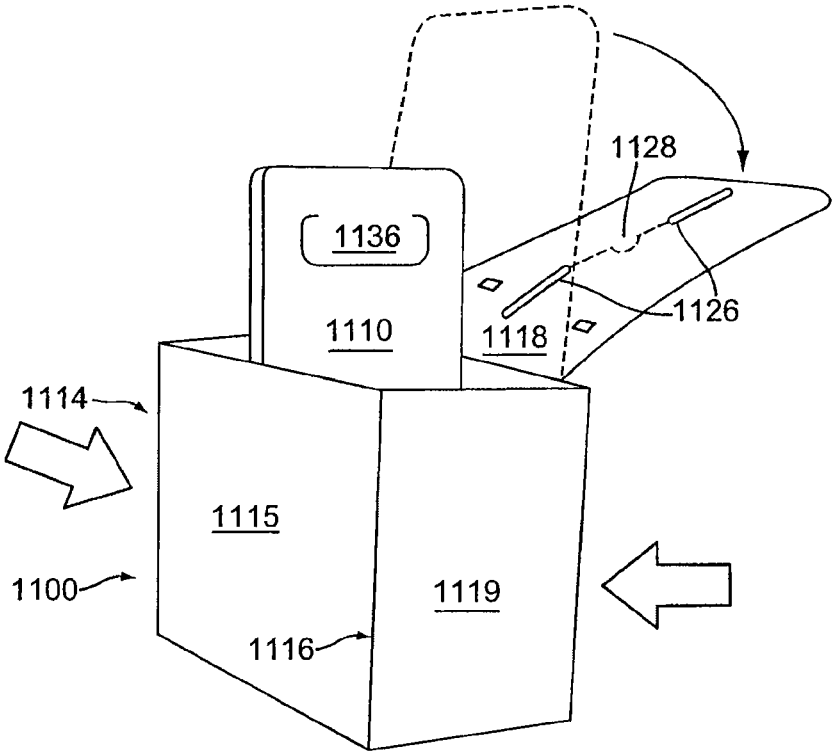
FIG. 13 is a perspective view of the carrier of FIG. 11 particularly illustrating the flexibility of the handle flap.

FIG. 13 is a perspective view of the carrier 1100. This view particularly illustrates the ability of the handle panel 1118 to bend such that the apertures 1126 may be fixed over the container handle 111. This view further illustrates that the carrier 1100 may be expanded into a box-like form from a flattened, collapsed form by asserting pressure on the container's end panels 1114, and 1119.

Figure 14:
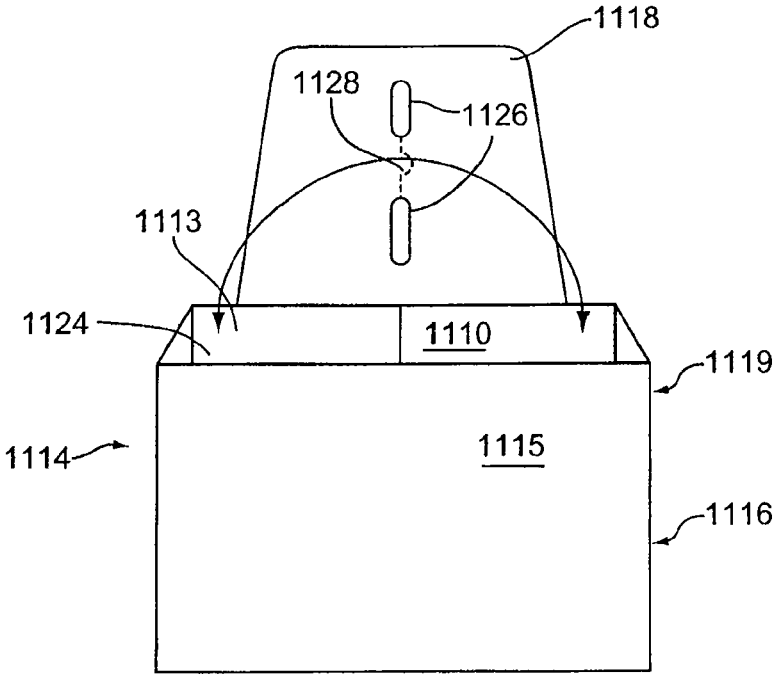
FIG. 14 is a perspective view of the carrier illustrating folding of the alternative handle flaps into the container.

FIG. 14 is a perspective view of the carrier 1100 particularly illustrating that the foldable handles 1110 may be flexed inward and tucked into the cavity of the compartment 1124. Folding the foldable handles 1110 into the compartment 1124 may eliminate any interference the handles might create when the carrier is affixed to a container.

Figure 15:
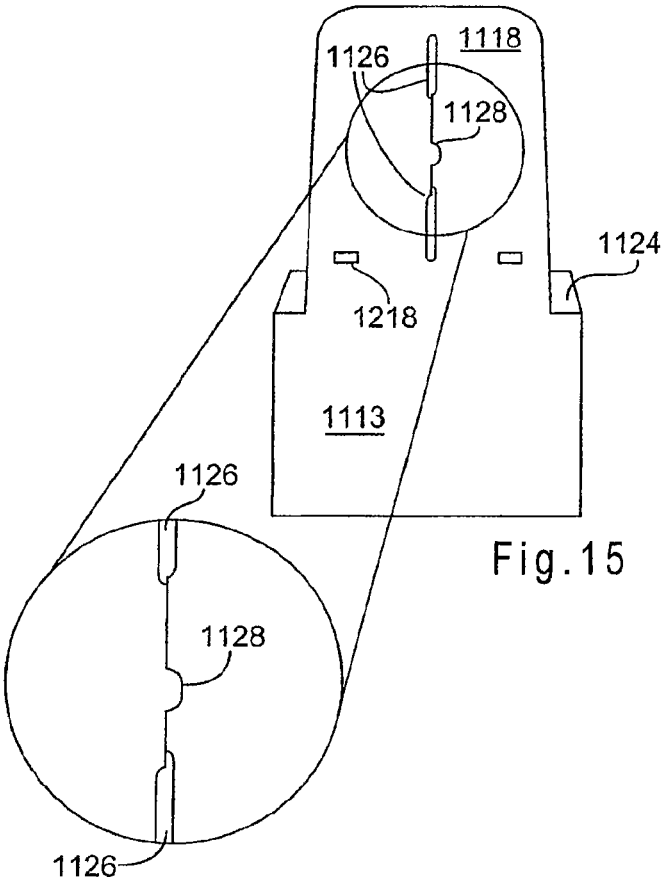
FIG. 15 is a perspective back view of the carrier of FIG. 11, with an exploded detail view of an overlapping central portion of the handle flap.

FIG. 15 provides a back view of the carrier 1100. The figure illustrates the perforated central region 1128 extending between the apertures 1126. This region may open to allow passage of the container's handle 111 while affixing the carrier 1100 to the container 110. However, it may close under the container handle 111 after assembly, providing a snug fit.

Figure 16:
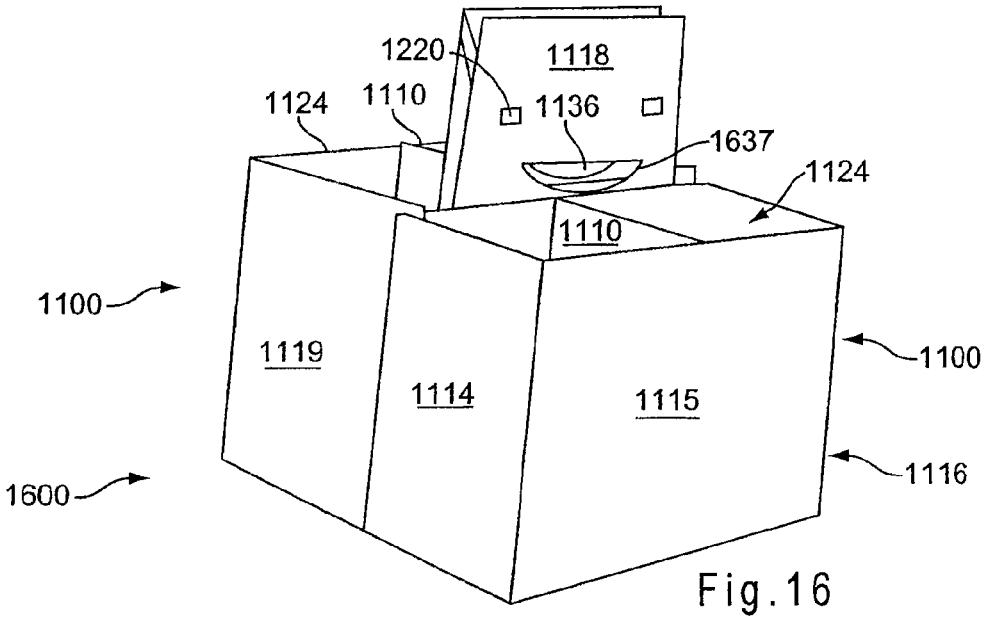
FIG. 16 is a fully assembled view of carriers combined together.

FIG. 16 is a perspective view of two carriers 1100 assembled in tandem. Folding the handle panel 1118 and securing two carriers 1100 in tandem results in a four-pack carrier. Pushing in on a perforated aperture 1136 may reveal a transversely elongated finger opening 1637 for carrying the four-pack carrier. The aperture 1136 is rectangular for illustration only. The aperture may be other shapes, or may be replaced with one or more finger holes. Accordingly, the finger opening 1637 may be other than transversely elongated.

Figure 17:
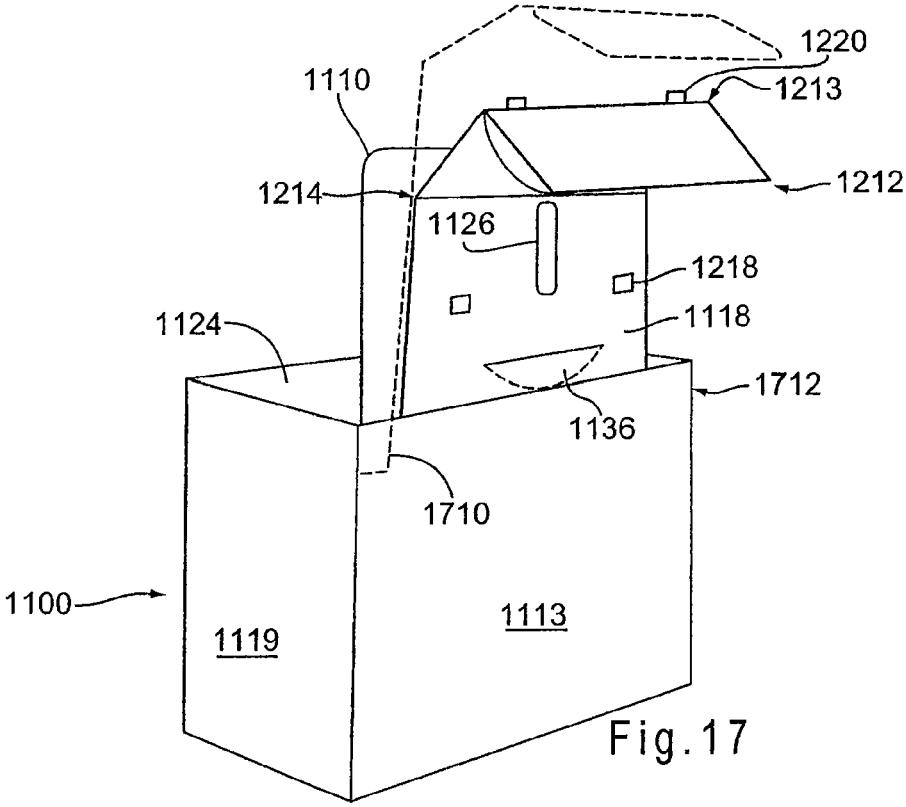
FIG. 17 is a perspective back view of the carrier of FIG. 11 illustrating optional folding of the back flap.
Figure 18:
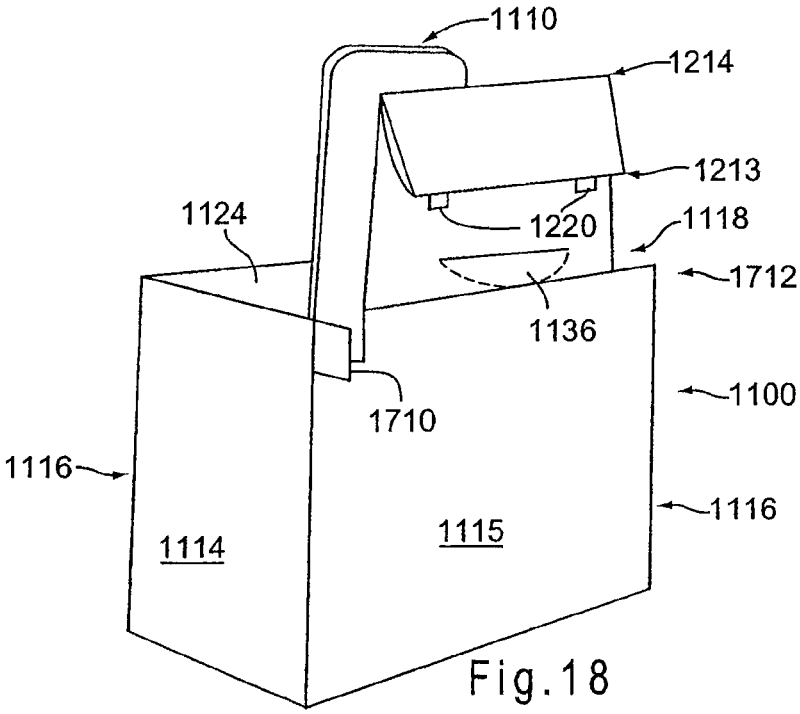
FIG. 18 is a perspective back view of the carrier of FIG. 11 and with the back flap folded such that the carrier may be used independent of the container.
Figure 19:
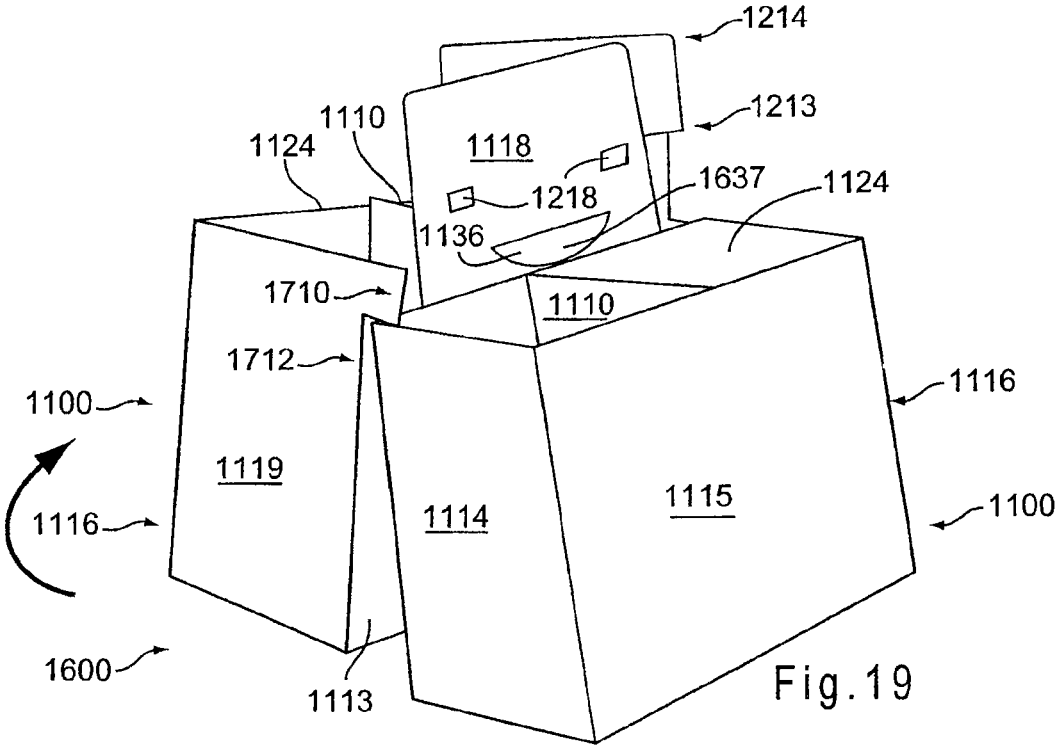
FIG. 19 is a partially assembled view of duplicate carriers illustrating the securing structures.

FIGS. 17-19 illustrate an exemplary folding of the handle panel 1118 and assembly of duplicate carriers 1100 into a four-pack carrier. The following description is by way of example only; other folding mechanisms may be used to accomplish the same end. FIG. 17 illustrates an exemplary folding of the handle panel 1118. The handle panel may be folded at a first 1212 and second 1213 fold line. Latching lugs 1220 may be released from the handle panel 1220 by pushing inward along the cutting lines 1244.

FIG. 18 is a back perspective view of the carrier 1100. Folding at the second folding line 1213 followed by folding at the third folding line 1214 may bring the latching lugs 1220 into immediate alignment with the latching apertures 1218. The fold may be secured by inserting the latching lug 1220 through the latching apertures 1218.

An example of a possible latching mechanism follows. The example is merely illustrative. Other latching mechanisms may be used. The first side panel 1113 may include a second latching lug 1710 defined by cutting lines along a first and second side. This latching lug may be cut along a third side to create a notch 1712 that divides the second lug 1710 from the body of the carrier 1100 at the corner region 1116. The lug remains integral with the carrier's first end panel 1114 at its uppermost region.

FIG. 19 illustrates an exemplary assembly of two two-compartment carriers 1100 into a four-compartment carrier 1600. The joining of two carriers 1100 to form a tandem four-compartment carrier 1600 may be effected simply and rapidly utilizing the joining lug 1710. Attachment may be achieved by first positioning the carriers 1100 slightly offset from each other with the latch lug 1710 of the first duplicate carrier aligned with a hatch 1712 cut into the second duplicate carrier. The latch lug 1710 is inserted into the hatch 1712, and the opposed carriers are brought into orientation by clockwise rotation such that the latch lug 1710 may fully engage the hatch 1712. Proper alignment orients the first and second transversely elongated finger openings 1637 such that the handle tongue 1136 of the first carrier 1100 can be inserted through the finger opening 1637 of the second carrier 1100. Latching the carriers together may restrict lateral separation of the carriers. This latching method may be replaced by or used in combination with other known latching methods.

Figure 20:
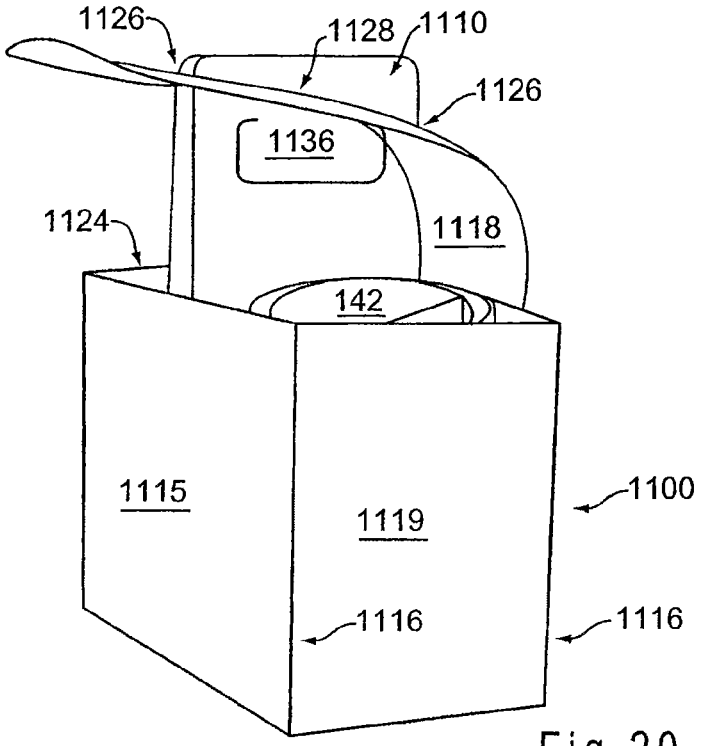
FIGS. 20 and 21 are exemplary partial perspective views of a fully assembled carrier particularly illustrating the handle flap folding over upright handle panels to form a compartment cover.
Figure 21:
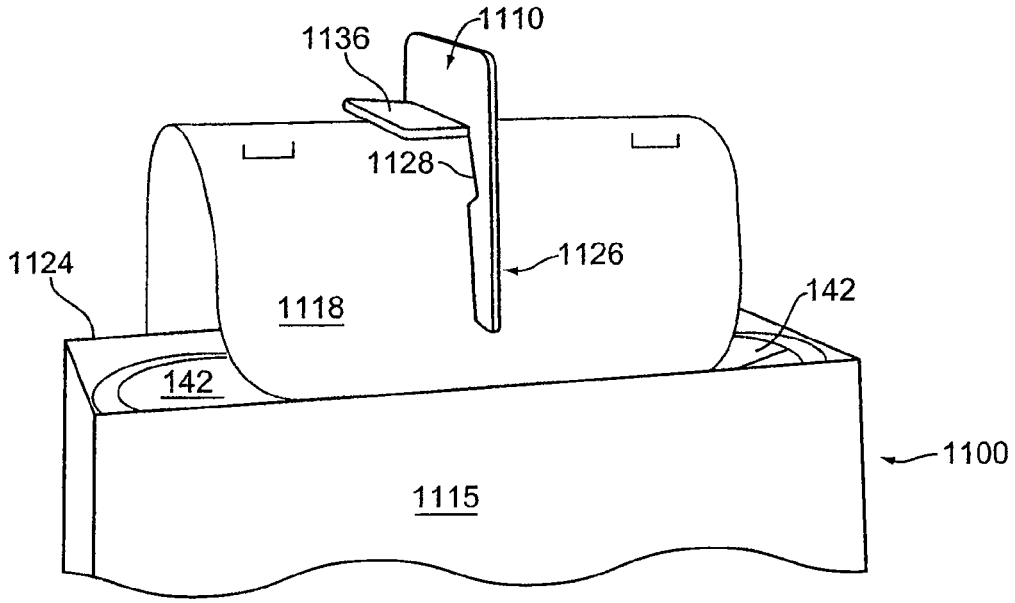

FIGS. 20 and 21 illustrate how the handle panel 1118 can bend forward and form a compartment cover on a single carrier. With the foldable handle panel divider 1110 erect, the foldable handle panel 1110 may be inserted through the apertures 1126 and central perforated region 1128 and secured by tucking in to the compartment 1124.

While various embodiments of the invention have been described, it will be apparent to those of ordinary skill in the art that many more embodiments and implementations are possible that are within the scope of the invention.

We claim:

1. A carrier comprising:
- a bottom;
- a plurality of side panels connected to the bottom; and
- a handle panel connected to one of the side panels or the bottom, the handle panel comprising:
  - a fold line;
  - a first aperture;
  - a second aperture;
  - a first perforated line in continuation of the first aperture and the second aperture;
  - wherein pressure applied on the first perforated line tears apart material to produce a third aperture in continuation of the first aperture and the second aperture;
  - a second perforated line defining a finger opening in the handle panel;
  - wherein pressure applied inside the second perforated line dislocates material to produce the finger opening; and
- wherein when the third aperture is open in continuation of the first aperture and the second aperture, the handle panel folds along the fold line over a container to facilitate penetration of a handle of the container through the first aperture, the second aperture, and the third aperture.

2. The carrier of claim 1, wherein the handle panel is formed in continuation of one of the side panels.

3. The carrier of claim 1, wherein the carrier is attachable back-to-back to an identical carrier.

4. The carrier of claim 3, wherein when the carrier is attached back-to-back to the identical carrier, the finger opening matches a finger opening in the identical carrier.

5. The carrier of claim 1, wherein the handle of the container securely fits in the first aperture, the second aperture, and the third aperture.

6. The carrier of claim 1, wherein the carrier provides an upwardly open compartment including a compartment corner and a pair of horizontal cutting lines forming a band cut into the compartment corner; wherein upon inward depression of the band, a partition forms in the upwardly open compartment, dividing the upwardly open compartment.

7. A carrier comprising:
- a bottom;
- a plurality of side panels connected to the bottom; and
- a handle panel connected to one of the side panels or the bottom, the handle panel comprising:
  - a fold line;
  - a first aperture;
  - a second aperture;
  - a perforated line in continuation of the first aperture and the second aperture;
  - wherein pressure applied on the first perforated line tears apart material to produce a third aperture in continuation of the first aperture and the second aperture;
- wherein when the third aperture is open in continuation of the first aperture and the second aperture, the handle panel folds along the fold line over a container to facilitate penetration of a handle of the container through the first aperture, the second aperture, and the third aperture; and
- wherein the carrier is attachable back-to-back to an identical carrier.

8. The carrier of claim 7, wherein the carrier provides an upwardly open compartment including a compartment corner and a pair of horizontal cutting lines forming a band cut into the compartment corner; wherein upon inward depression of the band, a partition forms in the upwardly open compartment, dividing the upwardly open compartment.

9. The carrier of claim 7, wherein when the handle panel folds along the fold line over the container and the handle of the container penetrates through the first aperture, the carrier hangs against a side of the container.

10. A carrier comprising:

a bottom;

a plurality of side panels connected to the bottom forming a compartment; and a handle panel connected to one of the side panels or the bottom, the handle panel comprising:

a fold line;

a handle opening;

a finger opening; and wherein the handle panel folds along the fold line over a container to facilitate penetration of a handle of the container through the handle opening wherein the compartment hangs against a side of the container.

11. The carrier of claim 10, wherein the handle panel is formed in continuation of one of the side panels.

12. The carrier of claim 10, wherein the carrier is attachable back-to-back to an identical carrier.

13. The carrier of claim 12, wherein when the carrier is attached back-to-back to the identical carrier, the finger opening matches a finger opening in the identical carrier.

14. A carrier comprising:

a bottom;

a plurality of side panels connected to the bottom and forming an open compartment;

wherein the open compartment is divided by a central foldable handle panel extending through the open compartment; and a side handle panel connected to one of the side panels or the bottom, the side handle panel comprising:

a fold line;

an aperture; and wherein the side handle panel folds over the central foldable handle panel to form a compartment cover.

15. The carrier of claim 14, wherein the side handle panel folds along the fold line over a container to facilitate penetration of a handle of the container through the aperture.

16. The carrier of claim 14, wherein when the side handle panel folds over the central foldable handle panel, a top edge of the central foldable handle panel penetrates the aperture.

17. The carrier of claim 16, wherein the central foldable handle panel includes a perforated line defining a moveable tongue in the central foldable handle panel, wherein pressure applied inside the second perforated line tears apart material to produce the moveable tongue; and wherein when the side handle panel folds over the central foldable handle panel and the central foldable handle panel penetrates the aperture, the tongue is flexed outward from the central foldable handle panel securing the side handle panel as the compartment cover.

18. The carrier of claim 14, wherein the handle panel is formed in continuation of one of the side panels.

19. The carrier of claim 14, wherein the carrier is attachable back-to-back to an identical carrier.

20. The carrier of claim 14, wherein the handle of the container securely fits in the aperture, and wherein the central foldable handle panel securely fits in the aperture.

* * * * *